United States Patent [19]

Gerling

[11] Patent Number: 4,711,983

[45] Date of Patent: Dec. 8, 1987

[54] FREQUENCY STABILIZED MICROWAVE POWER SYSTEM AND METHOD

[76] Inventor: John E. Gerling, 1648 Kansas Ave., Modesto, Calif. 95351

[21] Appl. No.: 882,223

[22] Filed: Jul. 7, 1986

[51] Int. Cl.[4] ..... H05B 6/70

[52] U.S. Cl. ..... 219/10.55 A; 219/10.55 F; 219/10.55 M

[58] Field of Search ..... 219/10.55 A, 10.55 F, 219/10.55 R, 10.55 M, 10.55 B; 333/17 R, 17 L, 17 M, 22 R, 22 F

[56] References Cited

U.S. PATENT DOCUMENTS

| | | | |
|---|---|---|---|
| 2,458,579 | 1/1949 | Feldman | 333/22 R |
| 2,718,580 | 9/1955 | Shirley | 219/10.55 R |
| 3,621,481 | 11/1971 | Perrault et al. | 333/22 F X |
| 3,622,732 | 11/1971 | Williams | 219/10.55 A |
| 3,715,551 | 2/1973 | Peterson | 219/10.55 A |
| 3,784,777 | 1/1974 | Soulier | 219/10.55 A |
| 3,806,837 | 4/1974 | Carr et al. | 333/17 R X |
| 4,275,283 | 6/1981 | Focht | 219/10.55 F |
| 4,323,746 | 4/1982 | Gerling | 219/10.55 F |
| 4,511,778 | 4/1985 | Takahashi et al. | 219/10.55 A |
| 4,617,440 | 10/1986 | Gics | 219/10.55 A |

*Primary Examiner*—Philip H. Leung

*Attorney, Agent, or Firm*—Flehr, Hohbach, Test, Albritton & Herbert

[57] ABSTRACT

System and method for applying microwave power of substantially constant frequency and variable power level to a work load. A microwave power source having an operating frequency which varies with power level is operated at a substantially constant power level and frequency. Power from the source is applied to a dummy load, and a portion of the power is diverted away from the dummy load to the work load to vary the amount of power applied to the work load without changing the power level or frequency at which the source is operated.

9 Claims, 3 Drawing Figures

FREQUENCY STABILIZED MICROWAVE POWER SYSTEM AND METHOD

This invention pertains generally to microwave heating, and more particularly to a system and method for applying microwave power of substantially constant frequency and variable power level to a load.

Applicators with resonant cavities are current employed for heating a variety of materials with microwave energy. These materials include extruded products and certain food products which are passed through the cavities and heated on a continuous basis. U.S. Pat. No. 3,673,370 describes an applicator for drying a latex impregnated fiber which passes continuously through a cavity, and U.S. Pat. No. 5,207,452 describes an applicator for generating an activated gas plasma for use in the manufacture of semiconductor devices.

The resonant cavity is advantageous in that it increases the electric field strength and heating capability for a given amount of microwave power, but it also has a relatively narrow bandwidth, e.g. 12 MHz for a center frequency of 2,450 MHz and a Q of 200. This makes it difficult to maintain the power from a microwave generator within the bandwidth of the cavity, particularly if the power level is changed as, for example, happens when the power level is brought up gradually. FIG. 1 illustrates the relationship between output power and frequency for a typical microwave generator. From this figure, it can be seen that the frequency can vary as much as about 40 MHz over the power range of the generator. With this much variation in frequency, it is necessary to retune the resonant cavity as the power level is changed, and this can be a difficult adjustment for many people to make and not desirable in a production process.

It is in general an object of the invention to provide a new and improved system and method for applying microwave power of substantially constant frequency and variable power level to a load.

Another object of the invention is to provide a system and method of the above character which are easy to use and do not require specially trained personnel.

These and other objects are achieved in accordance with the invention by operating a microwave power source at a substantially constant power level and frequency, applying power from the source to a dummy load, and diverting a portion of the power away from the dummy load to vary the amount of power applied to the work load without changing the power level or frequency at which the source is operated.

Figure 1:
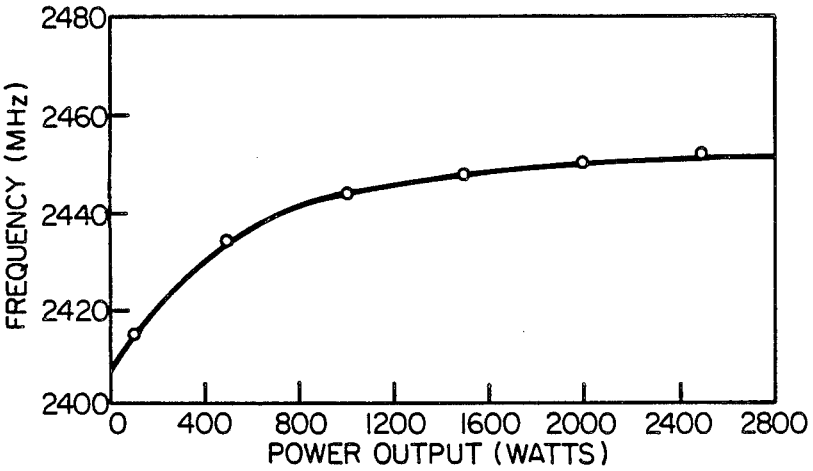
FIG. 1 is a graphical representation of the relationship between the frequency and output power level of a microwave power generator.
Figure 2:
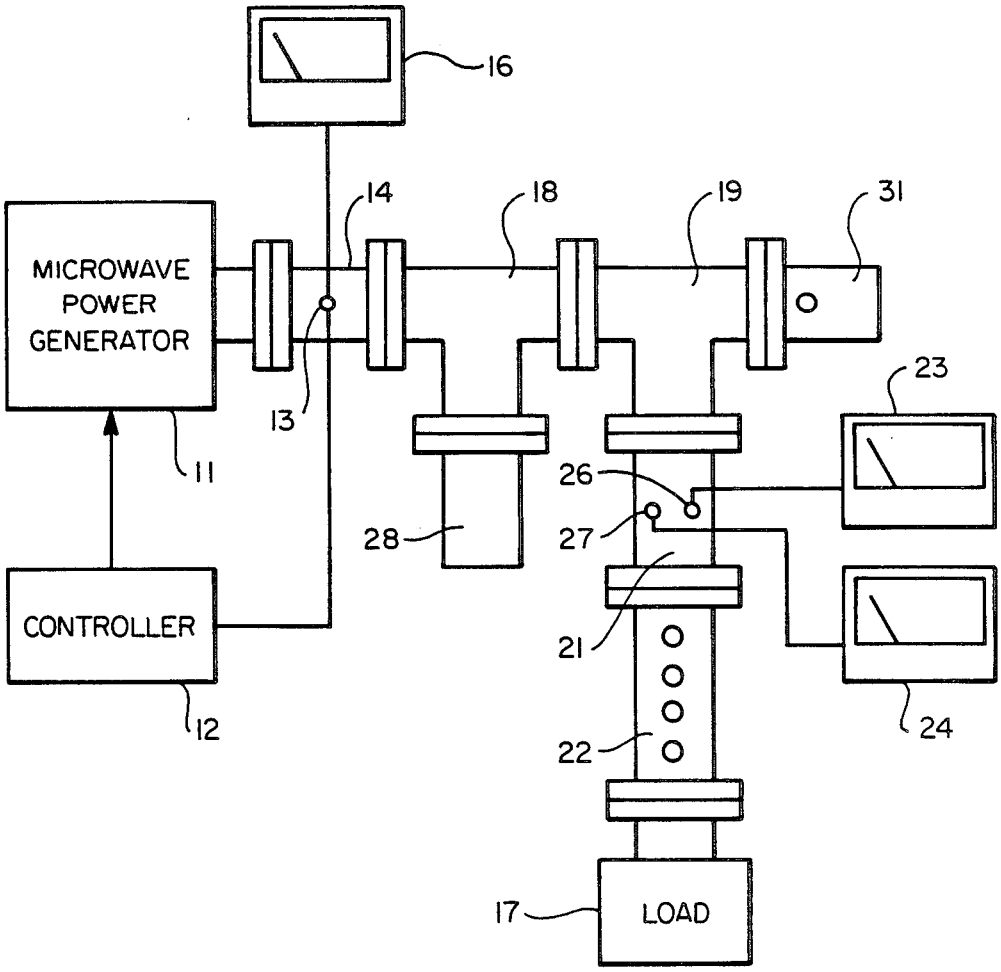
FIG. 2 is a schematic diagram of one embodiment of a microwave power system according to the invention.

As illustrated in FIG. 2, the system comprises a microwave power source 11 and a controller 12 which controls the operation of the power source. This source is a variable source such as a Model GL 103A variable power source, available from Gerling Laboratories, Modesto, Calif. This source generates microwave power at a nominal frequency of 2,450 MHz and power levels up to about 3,000 watts. The frequency of the power produced varies with the power level as illustrated in FIG. 1. A preferred controlled for use with this particular power source is a Gerling Laboratories Model GL 808 control unit. This unit controls the magnetron current level in the power source and can maintain the power source output at a constant level.

Power at the output of the source is monitored by a sensor 13 mounted in a short section of waveguide 14 connected to the output of the source. A power meter 16 is connected to the sensor to provide a visual indication of the generator output power, and the sensor is also connected to an input of controller 12 which maintains the output of the source at a preset level.

Power from the source is applied to a load 17 by a pair of 3 port circulators 18, 19. Each of the circulators provides unilateral power transmission from a first port to a second port, from the second port to a third port, and from the third port to the first port. Power from the source is applied to the first port of circulator 18, and the second port of this circulator is connected to the first port of circulator 19. The work load is connected to the third port of circulator 19 through a coupling waveguide 21 and a tuner 22. Forward and reflected power are monitored by power meters 23, 24 connected to sensors 26, 27 in coupling waveguide 21. A dummy load 28 is connected to the third port of circulator 18 to absorb any power reflected by the load and thus prevent this power from being returned to the generator.

Figure 3:
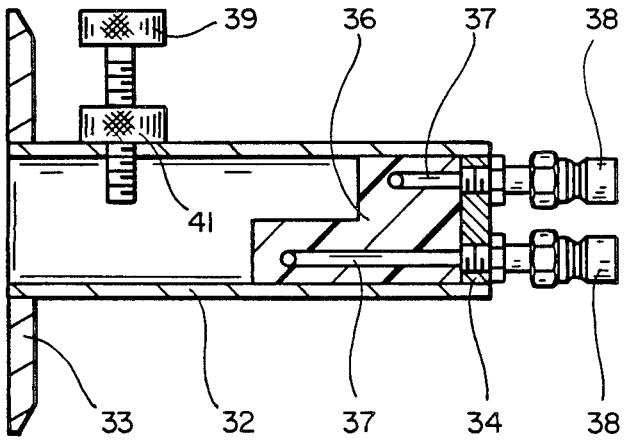
FIG. 3 is a vertical section view of one embodiment of an adjustable dummy load for use in the embodiment of the FIG. 2.

Means is provided for adjusting the amount of power delivered to the work load without changing the power output and operating frequency of the source. This means includes an adjustable dummy load 31 connected to the second port of 3 port circulator 19. As illustrated in FIG. 3, this dummy load comprises a housing comprising a short section of waveguide 32 with a mounting flange 33 at one end thereof and an end plate 34 at the other. A block 36 of dielectric material is mounted in the waveguide toward the closed end, and water passageways 37 are formed in this block. Circulating water is supplied to the passageways through connectors 38.

An adjustable tuning stub 39 is threadedly mounted in the top wall of waveguide 32 near the open or input end of the waveguide. A jam nut 41 locks the tuning stub in a desired position. When the tuning stub is fully retracted, substantially all of the power entering the waveguide is absorbed by the dummy load. When the tuning stub is fully inserted, approximately 95% of the power is reflected toward work load 17.

Operation and use of the embodiment of FIG. 2, and therein the method of the invention, are as follows. Controller 12 is set to provide a desired power output from generator 11 and to maintain the power at this level. Load 17 is tuned to resonance by adjusting tuner 22 to minimize the reflected power, as indicated by power meter 24. Tuning stub 39 is adjusted to control the amount of power reflected by dummy load 31 and applied to work load 17. As the tuning stub is advanced farther into the waveguide, a larger portion of the power from the generator is reflected and delivered to load 17. The amount of power delivered to the load is indicated by meter 23.

The invention has a number of important features and advantages. The amount of power applied to the load can be adjusted without changing the power level at which the generator is operating. Since the level of the generated power does not change, the frequency of this power remains substantially constant, and it is not necessary to continuously retune the load to center the bandwidth of the load on the frequency of the source.

This permits the power applied to the load to be brought up gradually simply by adjusting the dummy load. This can be done by a relatively unskilled person or automatically in a production situation.

It is apparent from the foregoing that a new and improved system and method for applying microwave power have been provided. While only certain presently preferred embodiments have been described in detail, as will be apparent to those familiar with the art, certain changes and modifications can be made without departing from the scope of the invention as defined by the following claims.

What is claimed is:

1. In a system for applying different levels of microwave power to a work load at a substantially constant frequency from a microwave power source which operates at different frequencies at different power levels: a dummy load, means for applying microwave power from the source to the dummy load and to the work load, and means for varying the relative amounts of the microwave power delivery to the dummy load and to the work load to adjust the amount of power delivered to the work load without changing either the level at which the source operates or the frequency of the power delivered to the work load.

2. The system of claim 1 wherein the means for varying the relative amounts of the microwave power delivered to the dummy load and to the work load comprises an adjustable microwave power reflector.

3. The system of claim 1 wherein the means for applying the microwave power comprises a 3 port circular having a first port connected to the power source, a second port connected to the dummy load and a third port connected to the load, said 3 port circulator providing unilateral transmission of microwave power from the first port to the second port and from the second port to the third port.

4. The system of claim 1 wherein the means for varying the relative amounts of the microwave power delivered to the dummy load and to the work load comprises an adjustable tuning stub which reflects microwave power away from the dummy load.

5. The system of claim 1 including means for maintaining the power output of the power source at a substantially constant level.

6. In a system for applying microwave power to a work load: a source which delivers microwave power at different frequencies at different power levels, means for controlling operation of the source to maintain the power delivered by the source at a substantially constant power level and frequency, a first dummy load, a first 3 port circulator having a first port connected to the source, a second port, and a third port connected to the first dummy load, a second dummy load, a second 3 port circulator having a first port connected to the second port connected to the second dummy load and a third port connected to the work load, each of said 3 port circulators providing substantially unilateral transmission of power from the first port thereof to the second port and from the second port to the third port, and means for reflecting a portion of microwave power from the second dummy load to the third port of the second 3 port circulator.

7. The system of claim 6 wherein the means for reflecting a portion of the microwave power comprises an adjustable tuning stub.

8. In a method of applying microwave power of substantially constant frequency to a work load from a microwave power source which operates at different frequencies at different power levels, the steps of: operating the microwave power source at a substantially constant power level and frequency, applying power from the source to a dummy load and to the work load, and varying the relative amounts of the power delivered to the dummy load and to the work load to adjust the amount of power applied to the work load without changing the power level or frequency at which the source is operated.

9. The method of claim 8 including the step of inserting a reflector between the power source and the dummy load to control the amount of power diverted to the respective loads.

* * * * *